US009750993B2

(12) United States Patent
Ritchie et al.

(10) Patent No.: US 9,750,993 B2
(45) **Date of Patent: *Sep. 5, 2017**

(54) WEIGHTED IRON SET

(71) Applicant: Acushnet Company, Fairhaven, MA (US)

(72) Inventors: Ryan J. A. Ritchie, Huntington Beach, CA (US); Marni Ines, San Marcos, CA (US); Jonathan Hebreo, San Diego, CA (US); Michael E. Franz, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 21 days.

This patent is subject to a terminal disclaimer.

(21) Appl. No.: 14/964,169

(22) Filed: Dec. 9, 2015

(65) Prior Publication Data

US 2016/0243413 A1 Aug. 25, 2016

Related U.S. Application Data

(63) Continuation-in-part of application No. 14/626,531, filed on Feb. 19, 2015, now abandoned.

(51) Int. Cl.

| | |
|---|---|
| ***A63B 53/04*** | (2015.01) |
| ***A63B 53/06*** | (2015.01) |
| *A63B 53/00* | (2015.01) |

(52) U.S. Cl.

CPC ..... *A63B 53/047* (2013.01); *A63B 2053/005* (2013.01); *A63B 2053/0408* (2013.01); *A63B 2053/0491* (2013.01); *A63B 2209/00* (2013.01)

(58) Field of Classification Search

CPC ..... A63B 2053/005; A63B 2053/0491; A63B 53/047; A63B 2053/0408; A63B 2209/00

See application file for complete search history.

(56) References Cited

U.S. PATENT DOCUMENTS

| | | | | | |
|---|---|---|---|---|---|
| 3,995,865 | A | * | 12/1976 | Cochran | A63B 53/04 473/337 |
| 4,811,950 | A | * | 3/1989 | Kobayashi | A63B 53/04 473/335 |
| 4,874,171 | A | | 10/1989 | Ezaki et al. | |
| 5,295,686 | A | | 3/1994 | Lundberg | |
| 5,524,880 | A | * | 6/1996 | Kobayashi | A63B 53/00 473/290 |
| 5,669,826 | A | | 9/1997 | Chang | |
| 5,722,900 | A | | 3/1998 | Sung | |
| 5,833,551 | A | * | 11/1998 | Vincent | A63B 53/04 473/349 |
| 5,935,020 | A | | 8/1999 | Stites et al. | |
| 5,984,803 | A | * | 11/1999 | Chappell | A63B 53/0466 473/287 |

(Continued)

FOREIGN PATENT DOCUMENTS

| | | |
|---|---|---|
| JP | H06-48724 | 7/1994 |
| JP | H06-41565 | 11/1994 |

(Continued)

*Primary Examiner* — Stephen Blau

(57) ABSTRACT

The present invention is direct to a set of golf clubs comprising long irons, mid-irons and short irons. The invention contemplates the use of titanium or steel for the main body portion and significant tungsten weight members coupled to at least the toe via a mechanical fastener.

5 Claims, 10 Drawing Sheets

(56) References Cited

U.S. PATENT DOCUMENTS 6,089,990 A * 7/2000 Kimura ..... A63B 53/047 473/290
6,095,931 A 8/2000 Hettinger et al.
6,290,607 B1 9/2001 Gilbert et al.
6,348,014 B1 * 2/2002 Chiu ..... A63B 53/065 473/337
6,482,104 B1 11/2002 Gilbert
6,602,147 B2 8/2003 Shiraishi
6,623,374 B1 9/2003 Helmstetter et al.
6,773,360 B2 * 8/2004 Willett ..... A63B 53/0466 473/334
6,860,819 B2 3/2005 Gilbert
7,014,568 B2 * 3/2006 Pelz ..... A63B 53/04 473/287
7,022,028 B2 4/2006 Nagai et al.
7,186,187 B2 3/2007 Gilbert et al.
7,537,528 B2 * 5/2009 Rice ..... A63B 60/42 473/329
7,559,850 B2 7/2009 Gilbert et al.
7,588,503 B2 * 9/2009 Roach ..... A63B 53/047 473/332
7,632,194 B2 * 12/2009 Beach ..... A63B 53/0466 473/334
7,699,716 B2 4/2010 Burnett et al.
7,815,523 B2 10/2010 Knutson et al.
7,935,000 B2 * 5/2011 Stites ..... A63B 53/047 473/291
7,976,403 B2 7/2011 Gilbert et al.
8,133,129 B2 3/2012 Boyd et al.
8,157,673 B2 4/2012 Gilbert
8,197,357 B1 * 6/2012 Rice ..... A63B 53/0466 473/334
8,206,237 B2 * 6/2012 Gilbert ..... A63B 53/0475 473/309
8,235,832 B2 8/2012 Burnett et al.
8,235,843 B1 * 8/2012 Rice ..... A63B 53/0466 473/334
8,491,407 B2 7/2013 Shear et al.
8,608,585 B2 12/2013 Stites et al.
8,608,589 B2 12/2013 Ferguson et al.
8,753,219 B2 * 6/2014 Gilbert ..... A63B 53/047 473/291
8,753,226 B2 * 6/2014 Rice ..... A63B 53/0466 473/334
8,758,163 B2 6/2014 Stites et al.
8,821,313 B1 * 9/2014 Dawson ..... A63B 53/0475 473/329
9,011,270 B2 * 4/2015 Nakano ..... A63B 53/047 473/312
2007/0281796 A1 * 12/2007 Gilbert ..... A63B 53/0475 473/332
2008/0058113 A1 * 3/2008 Nicolette ..... A63B 53/047 473/290
2008/0161124 A1 7/2008 Kajita
2008/0318705 A1 12/2008 Clausen et al.
2010/0267461 A1 * 10/2010 Stites ..... A63B 53/0466 473/242
2010/0273565 A1 10/2010 Stites et al.
2010/0304886 A1 12/2010 Boyd et al.
2011/0250985 A1 10/2011 Stites et al.
2012/0064997 A1 * 3/2012 Sato ..... A63B 53/047 473/350
2012/0071270 A1 * 3/2012 Nakano ..... A63B 53/047 473/350
2013/0165251 A1 * 6/2013 Jorgensen ..... A63B 53/06 473/328
2015/0038263 A1 * 2/2015 Ueda ..... A63B 53/04 473/349
2016/0158612 A1 * 6/2016 Oldknow ..... A63B 53/06 473/338

FOREIGN PATENT DOCUMENTS

JP H08-38658 2/1996
JP H08-112380 5/1996
JP 9-96378 * 4/1997
JP 2002-533180 10/2002
JP 2006-81862 3/2006
JP 2006-141710 6/2006
JP 2006-320493 11/2006
JP 2011-520565 7/2011
JP 2012-525214 10/2012
JP 2013-13717 1/2013
JP 2013-523389 6/2013

* cited by examiner

WEIGHTED IRON SET

RELATED APPLICATIONS

The present invention is a continuation-in-part of co-pending U.S. application Ser. No. 14/626,531, filed on Feb. 19, 2015, which is hereby incorporated by reference in its entirety.

TECHNICAL FIELD OF THE INVENTION

The present invention generally relates to sets of iron golf clubs, and more particularly, to sets of iron golf clubs that are comprised of significant tungsten weighting.

BACKGROUND OF THE INVENTION

In conventional sets of "iron" golf clubs, each club includes a shaft with a club head attached to one end and a grip attached to the other end. The club head includes a face for striking a golf ball. The angle between the face and a vertical plane is called "loft." In general, the greater the loft is of the golf club in a set, the greater the launch angle and the less distance the golf ball is hit.

A set of irons generally includes individual irons that are designated as number 3 through number 9, and a pitching wedge. The iron set is generally complimented by a series of wedges, such as a lob wedge, a gap wedge, and/or a sand wedge. Sets can also include a 1 iron and a 2 iron, but these clubs are generally sold separate from the set. Each iron has a shaft length that usually decreases through the set as the loft for each club head increases, from the long irons to the short irons. The length of the club, along with the club head loft and center of gravity impart various performance characteristics to the ball's launch conditions upon impact. The initial trajectory of the ball generally extends between the impact point and the apex or peak of the trajectory. In general, the ball's trajectory for long irons, like the 3 iron, is a more penetrating, lower trajectory due to the lower launch angle and the increased ball speed off of the club. Short irons, like the 8 iron or pitching wedge, produce a trajectory that is substantially steeper and less penetrating than the trajectory of balls struck by long irons. The highest point of the long iron's ball flight is generally lower than the highest point for the short iron's ball flight. The mid irons, such as the 5 iron, produce an initial trajectory that is between those exhibited by balls hit with the long and short irons.

SUMMARY OF THE INVENTION

The present invention is directed to a set of golf clubs comprising at least a first club head having a loft between about 15 and 25 degrees (long irons), a second club head having a loft of between about 26 and 35 degrees (mid irons), and a third club head having a loft of about 36 degrees or greater (short irons). Within the set, the first, second and third club heads each have a heel, a toe, a topline, a sole, a hosel and a front face having a face center. Each of the club heads has a club head mass that is different than the other club head mass by at least 5 grams. Further, the set includes at least one club head that has a tungsten heel member and a tungsten toe member that together comprise more that 50% of the club head mass. More preferably, each of the long irons and the mid irons are comprised of tungsten weight members that are at least 50% of the club head mass.

The present invention is also directed to a set of irons where the long and mid irons each have a tungsten heel member and a tungsten toe member, wherein the tungsten heel member plus the tungsten toe member weigh 135 grams or greater. Preferably, the long and mid irons are comprised of titanium and tungsten and the tungsten portion forms more than 25% of the club heads' volume. In a preferred embodiment, the short iron is comprised of titanium and steel and the steel portion comprises between 50% and 70% of the club head mass.

The present invention is also directed to a set of golf clubs comprising at least a first club head having a loft between about 15 and 25 degrees, a second club head having a loft of between about 26 and 35 degrees, and a third club head having a loft of about 36 degrees or greater, where each club head has a club head mass that is different than the one preceding it by at least 5 grams and at least one club head is comprised of a steel body member and a steel face insert that together comprise less than 75 percent of the overall club head mass. Preferably, the club head includes a tungsten heel member and a tungsten toe member that together comprise more that 25% of the club head mass. More preferably, the tungsten heel member plus the tungsten toe member weigh 70 grams or greater.

In a preferred embodiment of the invention, the long irons and mid irons are comprised of steel and tungsten and the tungsten portion forms at least about 20 percent of the club heads' solid volume. Still further, at least one short iron can be comprised of steel and tungsten and the tungsten portion comprises at least about 20 percent of the club head mass.

The present invention also contemplates a set of golf clubs comprising at least a long iron having a first blade length, a first hosel length and a first scoreline width, a mid iron having a second blade length, a second hosel length and a second scoreline width, and a short iron having a third blade length, a third hosel length and a third scoreline width, where the blade lengths are approximately constant and the second hosel length is greater than the first hosel length and the third hosel length is greater than the second hosel length. Also the second scoreline width is preferably less than the first scoreline width and the third scoreline width is preferably less than the second scoreline width. In a preferred embodiment, the long iron has a first toe height, the mid iron has a second toe height greater than the first toe height and the short iron has a third toe height greater than the second toe height. Still further, the long iron can have a first sole width, the mid iron can have a second sole width less than the first sole width and the short iron can have a third sole width less than the second sole width.

In the preferred embodiment of the current invention, the long iron has a first tungsten toe member, the mid iron has a second tungsten toe member with greater mass than the first tungsten toe member and at least one short iron has a third tungsten toe member with greater mass than the second tungsten toe member. Conversely, in the preferred embodiment, the long iron has a first tungsten heel member and the mid iron has a second tungsten heel member with less mass than the first tungsten heel member.

The present invention is also directed to a set of golf clubs comprising at least a first club head having a loft between about 15 and 25 degrees, a second club head having a loft of between about 26 and 35 degrees, and a third club head having a loft of about 36 degrees or greater, wherein each club head having a club head mass that is different than the previous club head by at least 5 grams, and wherein at least one of the club heads includes a weight member formed of tungsten and coupled to the toe that comprises 15%-25% of the club head mass. More preferably, the weight member is coupled to the golf club to form a portion of the back surface, the toe surface and the sole surface via a mechanical fastener. The club head can also include an indentation that forms a wall surrounding a portion of the weight member that has an angle between about 10 degrees and 60 degrees such that the weight member is press fit against the wall when the mechanical fastener is tightened. The club can also include a bottom surface and an adhesive tape is juxtaposed the bottom surface and the weight member. In a most preferred embodiment, the mechanical fastener is inserted through a face side of the club and extends through an aperture in the club and the club and the weight member form a paint fill edge that surrounds the weight member perimeter.

DETAILED DESCRIPTION OF THE PREFERRED EMBODIMENTS

As illustrated in the accompanying drawings and discussed in detail below, the present invention is directed to an improved set of iron-type golf clubs, wherein the clubs have tungsten weight members that form a significant portion of the club heads' mass.

Figure 1:
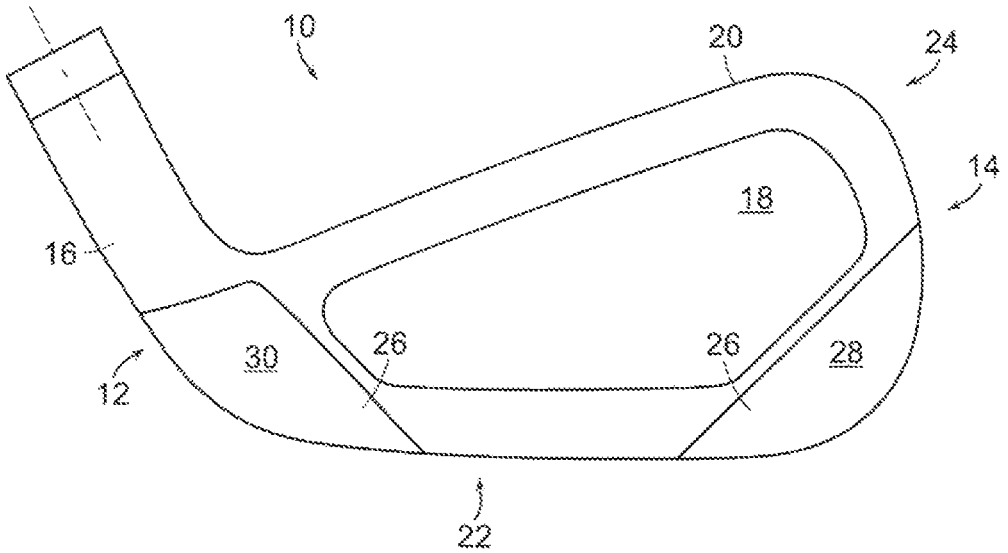
FIG. 1 is a back view of an iron according to the present invention.
Figure 2:
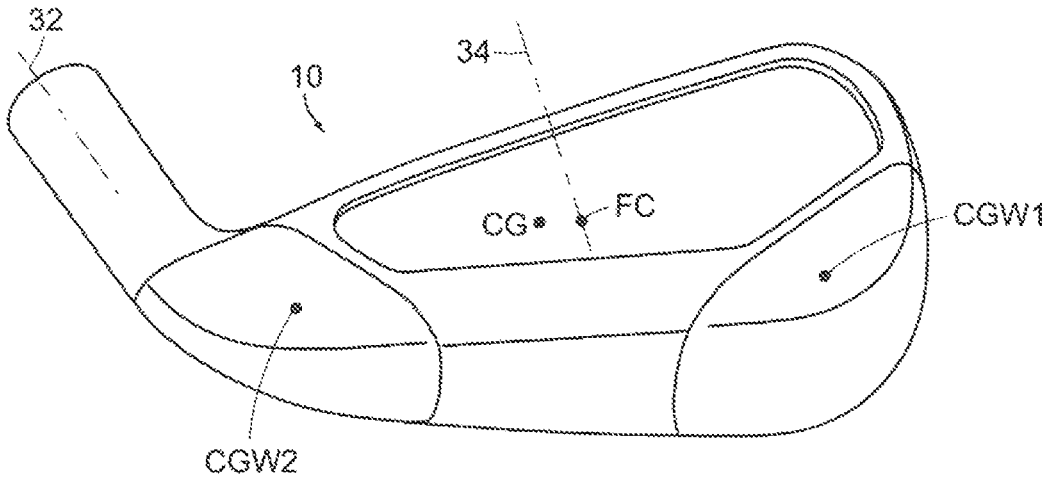
FIG. 2 is a perspective view of the iron in FIG. 1.

Referring to FIGS. 1 and 2, an iron 10 has a heel 12, a toe 14, a hosel 16, a back cavity 18 a top line 20 and a sole 22. The iron is comprised of two main components, the main body 24 and the weight members 26. The iron includes a hosel axis 34 and a face center FC. The main body 24 is formed from titanium, or more preferably, a titanium alloy. For at least the long irons and mid irons, the weight members include a toe weight member 28 and a heel weight member 30 that are formed from tungsten or more preferably a tungsten alloy having a specific gravity of 15 g/cm3 or greater. Thus, the main body 24 will have a specific gravity of about 4-5 g/cm3 and the weight members 26 will have a specific gravity of about 15-20 g/cm3.

Table I provides exemplary, non-limiting dimensions for the various measurements of clubs according to the Example of the invention. It is fully intended that all of the dimensions set forth below can be adjusted such that the overall objective of the individual irons is met.

TABLE I

| Club Number | 3 | 4 | 5 | 6 | 7 | 8 | 9 | P |
|---|---|---|---|---|---|---|---|---|
| loft | 21 | 24 | 27 | 30 | 34 | 38 | 42 | 46 |
| Mass | 238 | 245 | 252 | 259 | 266 | 274 | 282 | 286 |
| Ti (g) | 103 | 100 | 102 | 109 | 116 | 94 | 102 | 106 |
| W (g) | 135 | 145 | 150 | 150 | 150 | | | |
| Steel (g) | | | | | | 180 | 180 | 180 |
| Ti % | 43.3 | 40.8 | 40.5 | 42.1 | 43.6 | 34.3 | 36.2 | 37.1 |
| W % | 56.7 | 59.2 | 59.5 | 57.9 | 56.4 | | | |
| Steel % | | | | | | 65.7 | 63.8 | 62.9 |
| Ti vol. ($cm^3$) | 22.9 | 22.2 | 22.7 | 24.2 | 25.8 | 20.9 | 22.7 | 23.6 |
| W vol. ($cm^3$) | 9.0 | 9.7 | 10 | 10 | 10 | | | |
| Steel Vol. ($cm^3$) | | | | | | 24 | 24 | 24 |

Referring to the data in Table I above, the set of irons according to the present invention can be separated into long irons that have a loft of between about 15 and 25 degrees, mid irons that have a loft of between about 26 and 35 degrees and short irons that have a loft of about 36 or greater. The total mass of the clubs increases throughout the set from about 235 grams to about 290 grams. Each club is preferably about 5 grams or more greater in mass than the previous iron. As shown, for example, the 4 iron is 7 grams greater than the 3 iron. Thus, the mass increases through the set.

Each of the irons includes a titanium body member. The long irons and the mid irons preferably have tungsten weight members 28 and 30 as shown in FIGS. 1 and 2. In the long irons, the titanium body member 24 has a mass that is less than about 120 grams and more particularly, about 100 grams. The toe weight member 28 and heel weight member 30 preferably have a mass of about 130 grams to 150 grams. Thus, the tungsten weight members are greater than 50% of the total club mass.

In the mid irons, the titanium body member 24 has a mass that is less than about 120 grams and more particularly, about 100 grams to about 115 grams. The tungsten toe weight member 28 and heel weight member 30 preferably have a mass of about 140 grams to 160 grams, and more particularly about 150 grams. Thus, the tungsten weight members are greater than 50% of the total club mass. Also, the tungsten weight members 28 and 30 have greater mass than the tungsten weight members 28 and 30 for the long irons.

In the short irons, the titanium body member 24 has a mass that is less than about 120 grams and more particularly, about 90 grams to about 110 grams. The toe weight member 28 and heel weight member 30 are preferably made of steel and preferably have a mass of about 160 grams to 200 grams, and more particularly about 180 grams. Thus, the steel weight members are greater than 50% of the total club mass. Also, the steel weight members 28 and 30 have greater mass than the tungsten weight members 28 and 30 for the long irons and of the mid irons.

TABLE II

| Club Number | 2 | 3 | 4 | 5 | 6 | 7 | 8 | 9 | P |
|---|---|---|---|---|---|---|---|---|---|
| loft | 17 | 20 | 23 | 26 | 29 | 33 | 37 | 41 | 45 |
| Total Mass (g) | 234 | 239 | 246 | 252 | 256 | 267 | 274 | 282 | 286 |
| Body Mass (g) | 116 | 117 | 118 | 118 | 132 | 139 | 164 | 170 | 240 |
| Face Mass (g) | 34 | 37 | 38 | 38 | 38 | 39 | 41 | 41 | 41 |
| Toe W (g) | 38 | 45 | 50 | 55 | 61 | 60 | 61 | 63 | |
| Heel W (g) | 34 | 32 | 31 | 31 | 20 | 20 | | | |
| Steel Mass % | 70 | 68 | 67 | 66 | 68 | 70 | 78 | 78 | 100 |
| W Mass % | 30 | 32 | 33 | 34 | 32 | 30 | 22 | 22 | |
| Steel vol. % | 80 | 79 | 78 | 77 | 80 | 81 | 86 | 86 | 100 |
| W vol. % | 20 | 21 | 22 | 23 | 20 | 19 | 14 | 14 | |

TABLE III

| Club Number | 2 | 3 | 4 | 5 | 6 | 7 | 8 | 9 | P |
|---|---|---|---|---|---|---|---|---|---|
| loft | 17 | 20 | 23 | 26 | 29 | 33 | 37 | 41 | 45 |
| Blade Length (mm) | 77.6 | 77.6 | 77.6 | 77.6 | 77.6 | 77.6 | 77.6 | 77.6 | 77.6 |
| Toe Height (mm) | 51.9 | 52.3 | 52.8 | 53.3 | 53.8 | 54.3 | 54.9 | 55.4 | 55.8 |
| Scoreline Width (mm) | 53.2 | 53.0 | 52.8 | 52.7 | 52.5 | 52.3 | 52.2 | 52 | 51.8 |
| Scoreline to Toe (mm) | 17.3 | 17.5 | 17.7 | 17.8 | 18 | 18.2 | 18.3 | 18.5 | 18.7 |
| Hosel Length (mm) | 62 | 63 | 64 | 65 | 66 | 67 | 68 | 69 | 70 |
| Sole Width (mm) | 19.7 | 19.4 | 19.0 | 18.5 | 18.0 | 17.4 | 16.8 | 16.1 | 15.4 |

Figure 3:
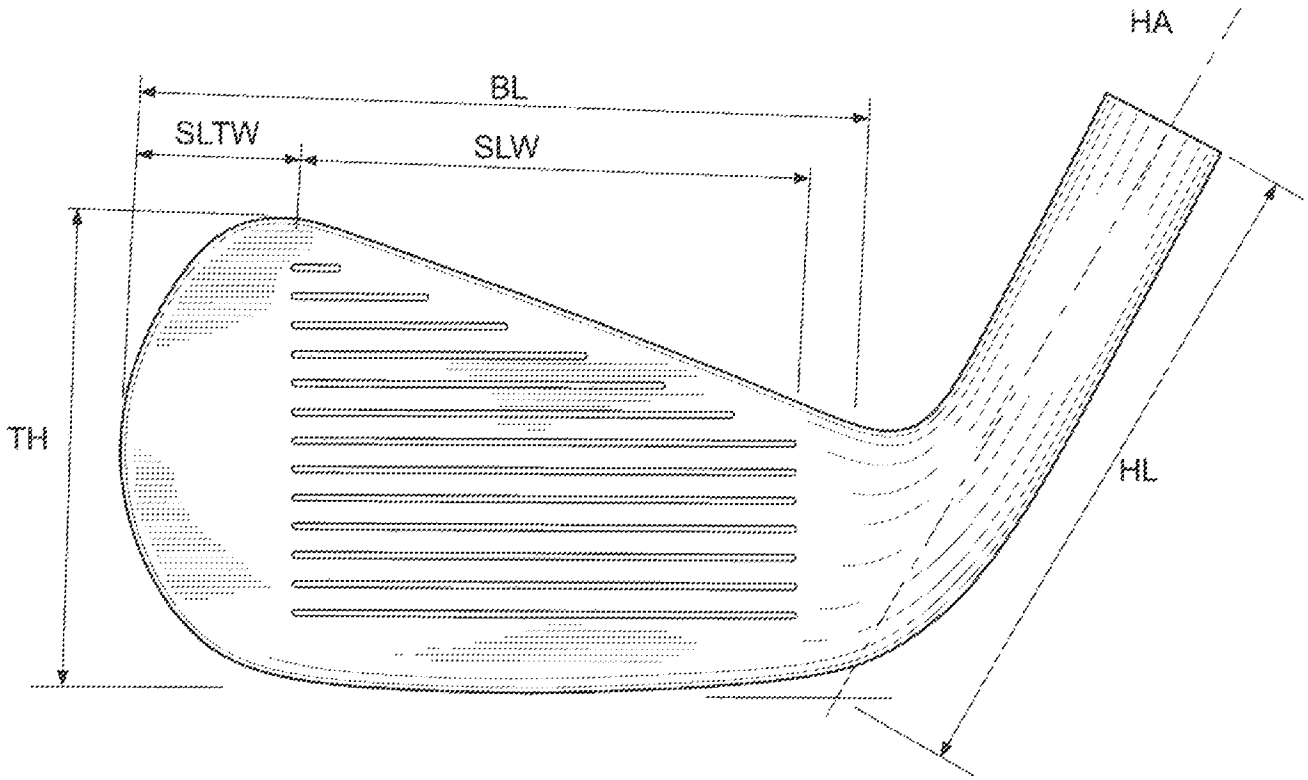
FIG. 3 is a front view of a long iron according to another embodiment of the present invention.

As shown in FIG. 3 and set forth in Table III above, another embodiment of the present invention includes a set of irons that have a substantially constant Blade Length (BL) throughout the set. The BL is defined at the length from the hosel axis (HA) intersection with the ground plane to the end of the toe. However in this set, the Toe Height (TH) progressively increases through the set. Thus, the TH of the mid iron is greater than the TH of the long iron and the TH of the short iron is greater than the TH of the mid iron and the long iron. The TH is defined as the maximum length from the leading edge to the top of the toe in the plane parallel to the face plane and perpendicular to the scorelines. Preferably, the TH increases by about at least 0.3 mm per club, and most preferably at least 0.4 mm per club. Also, the TH preferably increases at least 1 mm per club (or about 4 degrees of loft) for the short irons and only 0.3-0.6 mm per club for the long and mid irons.

Furthermore, even though the BL remains substantially constant through the set, the scoreline width (SLW) progressively decreases through the set and the scoreline to toe width (SLTW) progressively increases through the set. More particularly, the SLW decreases by at least about 0.1 mm per club (or per 4 degrees of loft). Thus, the SLW for the long iron is greater than the SLW for the mid iron and the SLW for the mid iron is greater than the SLW for the short iron. Moreover, because the SLTW progressively increases through the set, the non-grooved toe area increases throughout the set.

Still further, in this preferred embodiment of the present invention, the distance of the center of gravity from the face center progressively increases through the set. Thus, CG-Xfc progressively increases from less than 2 mm from the face center in the long irons to about 3 mm from the face center towards the hosel in the short irons.

Another aspect of the present invention is that the hosel length HL increases through the set. Preferably, the hosel length increases by about 1 mm/club (or per 4 degrees of loft) such that the HL of the mid irons is greater than the HL of the long irons and the HL of the short irons is greater than the HL of the mid irons. Also, the sole width, not shown in the figures because it is the width of the sole at the center of the club head perpendicular to the front view shown in FIG. 3, decreases through the set. Thus, the sole width of the mid irons is less than the sole width of the long irons and greater than the sole width of the short irons. Preferably, the sole width decreases by about 0.3 mm/club (or per 4 degrees of loft).

Figure 4:
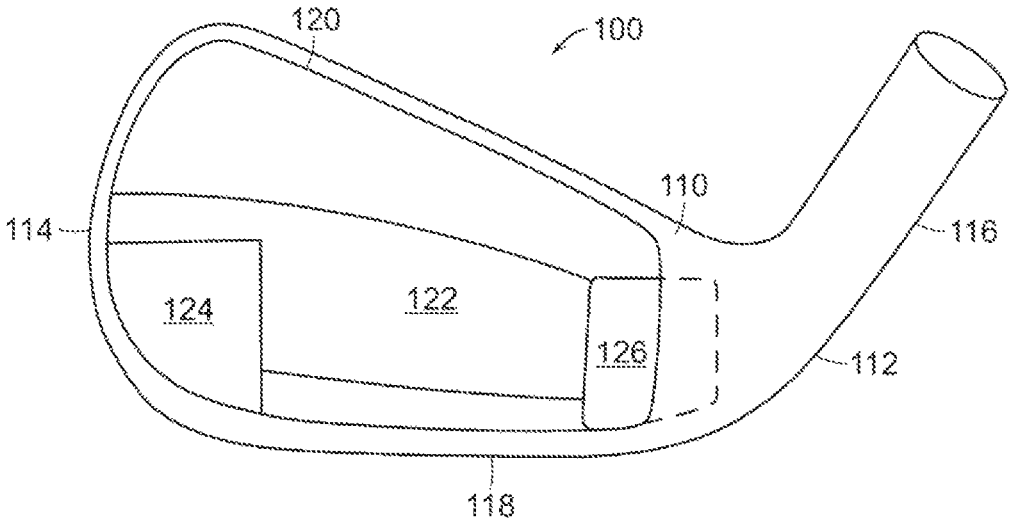
FIG. 4 is a front view of a long iron body member according to the present invention.

As shown in FIGS. 4-7 and set forth in the table above, the set includes a long iron 100, a mid iron 200, a first short iron 300 and a second short iron 400. In FIG. 4, the long iron 100 includes a body member 110, heel 112, a toe 114, a hosel 116 and a sole 118. The iron body 110 includes an insert aperture 120 and a hollow portion 122. A face insert, not shown, is welded to the insert aperture 120 to enclose the hollow portion 122. Both the body member 110 and the face insert are preferably formed of steel. Inside the hollow portion 122, a tungsten toe weight member 124 and a tungsten heel weight member 126 are located proximate the toe 114 and the heel 112, respectively, to create a high moment of inertia. As shown in Table II above, the body member 110 preferably has a mass of about 110 grams to 120 grams and the face insert has a mass of about 30 grams to 45 grams. In the long irons 100, the toe weight member 124 preferably has a mass of about 35 to 55 grams. Preferably, the toe weight member 124 mass increases with each club by about 5 grams per club. The heel weight member 126 is preferably about 30 grams to 35 grams and preferably decreases by about 1 or 2 grams per club. Preferably, the tungsten mass of the toe weight member 124 and the heel weight member 126 are at least 25% of the total club head mass and at least 15% of the total club head solid volume. More particularly, the toe weight member 124 and the heel weight member comprise about 30% of the total mass or more and 20% of the total solid volume. Preferably, the toe weight member 124 has greater mass than the heel weight member 126.

Figure 5:
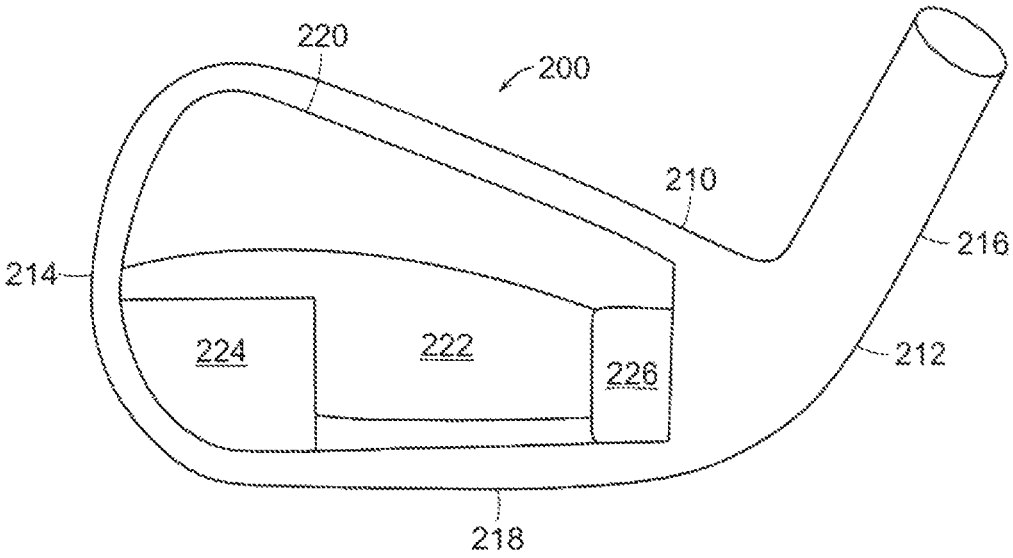
FIG. 5 is a front view of a mid-iron body member according to the present invention.

As shown in FIG. 5 and set forth in Table II above, the set includes a mid iron 200 that includes a body member 210, heel 212, a toe 214, a hosel 216 and a sole 218. The iron body 210 includes an insert aperture 220 and a hollow portion 222. A face insert, not shown, is welded to the insert aperture 220 to enclose the hollow portion 222. Both the body member 210 and the face insert are preferably formed of steel. Inside the hollow portion 222, a tungsten toe weight member 224 and a tungsten heel weight member 226 are located proximate the toe 214 and the heel 212, respectively, to create a high moment of inertia. As shown in Table II above, the body member 210 preferably has a mass of about 115 grams to 145 grams and the face insert has a mass of about 30 grams to 45 grams. In the mid irons 200, the toe weight member 224 preferably has a mass of about 50 to 70 grams. Preferably, the toe weight member 224 mass increases with each club by about 5 grams per club. The heel weight member 226 is preferably about 35 grams or less and preferably decreases per club. Preferably, the tungsten mass of the toe weight member 224 and the heel weight member 226 are at least 25% of the total club head mass and at least 15% of the total club head solid volume. More particularly, the toe weight member 224 and the heel weight member 226 comprise about 30% of the total mass or more and about 20% of the total solid volume. Preferably, the toe weight member 224 has greater mass than the heel weight member 226, and more preferably, is about twice the amount of mass.

Figure 6:
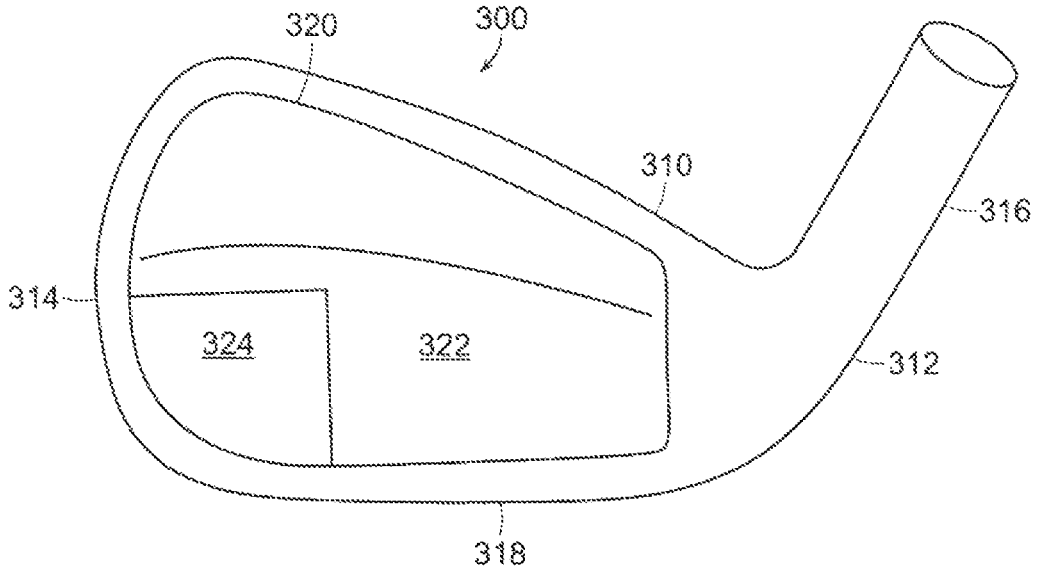
FIG. 6 is a front view of a short iron body member according to the present invention.

As shown in FIG. 6 and as set forth in Table II above, the set can include a short iron 300 that includes a body member 310, heel 312, a toe 314, a hosel 316 and a sole 318. The iron body 310 includes an insert aperture 320 and a hollow portion 322. A face insert, not shown, is welded to the insert aperture 320 to enclose the hollow portion 322. Both the body member 310 and the face insert are preferably formed of steel. Inside the hollow portion 322, a tungsten toe weight member 324 is located proximate the toe 314, to create a high moment of inertia. As shown in Table II above, the body member 310 preferably has a mass of about 150 grams to 200 grams and the face insert has a mass of about 30 grams to 45 grams. In the short iron 300, the toe weight member 324 preferably has a mass of about 55 to 70 grams. Preferably, the tungsten mass of the toe weight member 324 is at least 20% of the total club head mass and at least 10% of the total club head solid volume.

Figure 7:
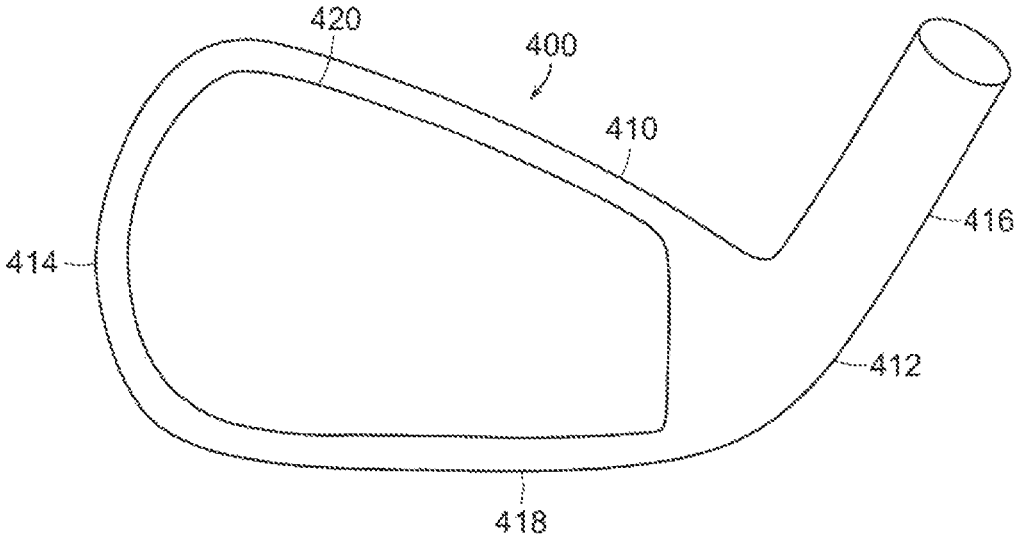
FIG. 7 is a front view of another embodiment of a short iron body member according to the present invention.

As shown in FIG. 7 and as set forth in Table II above, the set can include a short iron 400 that includes a body member 410, heel 412, a toe 414, a hosel 416 and a sole 418. The iron body 410 includes an insert aperture 420. A face insert, not shown, is welded to the insert aperture 420. The short iron 400 is preferably substantially solid and does not contain tungsten weight members.

Referring now to FIGS. 8-19, the present invention also includes a number of ways to attach the tungsten weight to a club head such that the weight and the head can be manufactured and finished separately. Preferably, the club head frame is cast or forged and then polished. The weight can be manufactured out of 17 g/cm3 tungsten and polished. After both components are polished, the weight member can be attached to the body via a mechanical fastener as discussed in more detail below.

Figure 8:
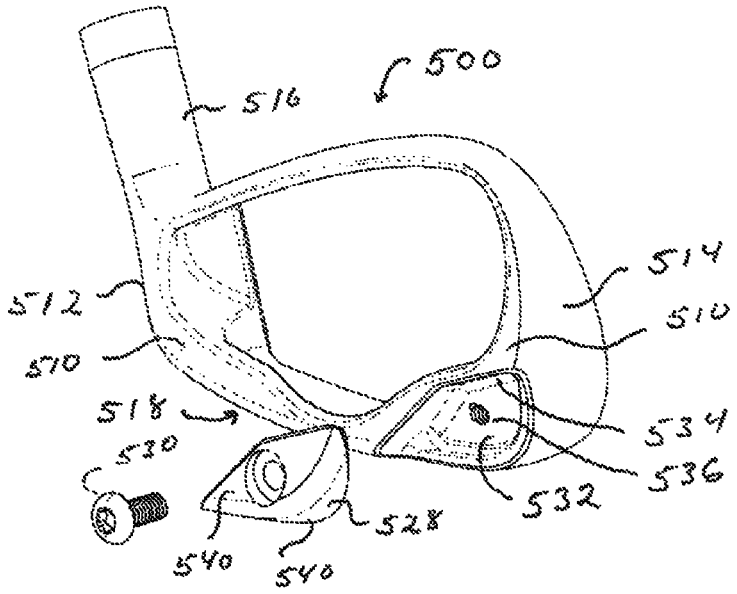
FIG. 8 is an exploded view of an iron according to the present invention.

As shown in FIG. 8, the iron body 500, includes a heel 512, a toe 514, a hosel 516 and a sole 518 and is preferably formed by forging steel or titanium as discussed above. The club head also includes a toe weight member 528 that is coupled to the body 500 by a mechanical fastener 530. The body 500 includes an indentation 532 on the toe 514 and sole 518 for receiving the weight member 528. The indentation 532 includes an inner wall 534 that surrounds a portion of the weight member 528 and a receptacle 536 for coupling with the mechanical fastener 530. In this embodiment, the receptacle 536 is a threaded aperture. As shown in the cross-sectional view of FIG. 9, the wall 534 is formed at an angle $\alpha$ such that the weight member is press fit into the indentation 532 when the mechanical fastener is tightened. Preferably, the angle $\alpha$ is between about 10 degrees and 60 degrees. The weight member 528 and the indentation 532 form a bottom interface 538. In a preferred embodiment, an adhesive tape may be applied at this interface to further secure the weight member 528 to the body 500. The body 500 also includes a back surface 510 and the weight member 528 has an outer surface 540. The outer surface of the weight member 528 preferably creates a lower portion of the toe 514, an outer, toe portion of the sole 518 and a portion of the back surface 510 for maximum MOI efficiency. In the preferred embodiment shown in FIGS. 8 and 9, the body 500 also includes a front surface 542 for welding the front face to, not shown. Further, a paint fill edge 544 can be formed in the weight member 528, the body 500 or both, as shown, to finish the club head and provide a visual separation of the weight member 528.

As discussed above, the toe weight member 528 preferably has a mass of about 35 to 65 grams. Preferably, the toe weight member 528 mass increases with each club by about 5 grams per club through at least a portion of the set. The club can further include a heel weight member that is not shown that is preferably about 30 grams to 35 grams and preferably decreases by about 1 or 2 grams per club through at least a portion of the set. A heel weight can be attached in the same manner as the toe weight member shown or can be placed behind the face insert as discussed above with respect to FIGS. 4 and 5. Preferably, the tungsten mass of the toe weight member 528 and the heel weight member are at least 25% of the total club head mass and at least 15% of the total club head solid volume. As set forth in Table II, and for all the embodiments, the toe weight member is preferably between about 15% and 25% of the total club mass.

Figure 10:
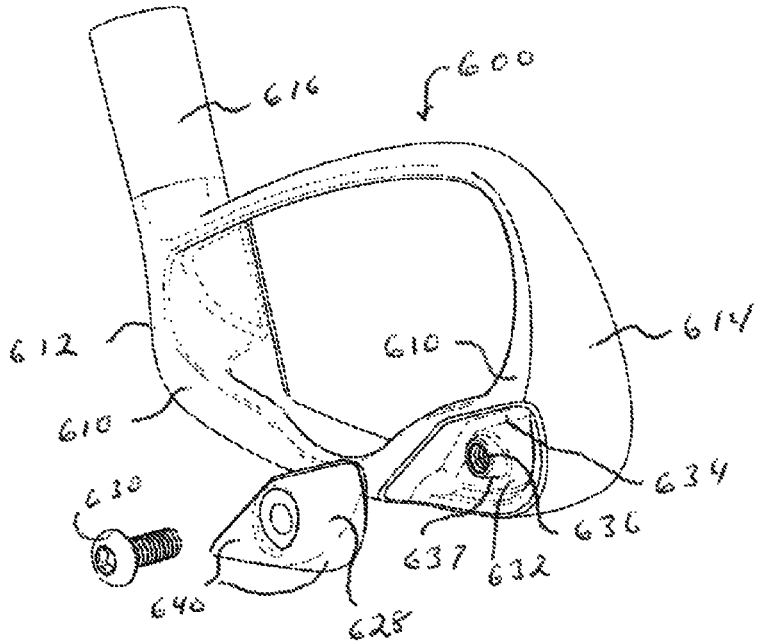
FIG. 10 is an exploded view of an iron according to the present invention.
Figure 11:
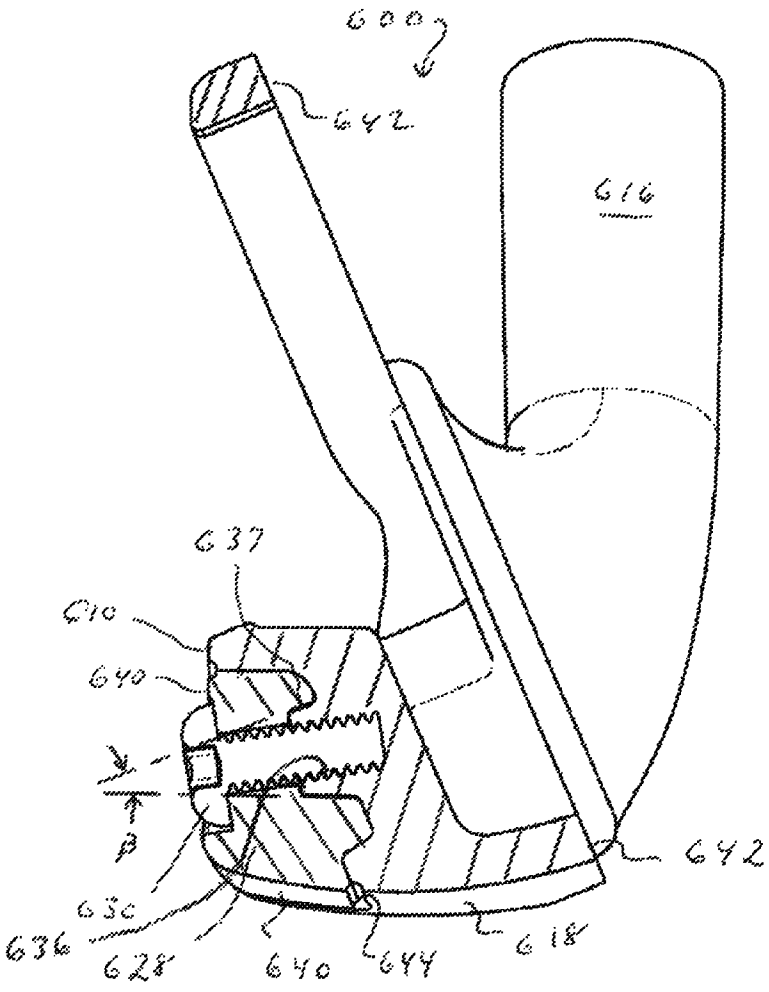
FIG. 11 is a cross-sectional view of the iron in FIG. 10.
Figure 9:
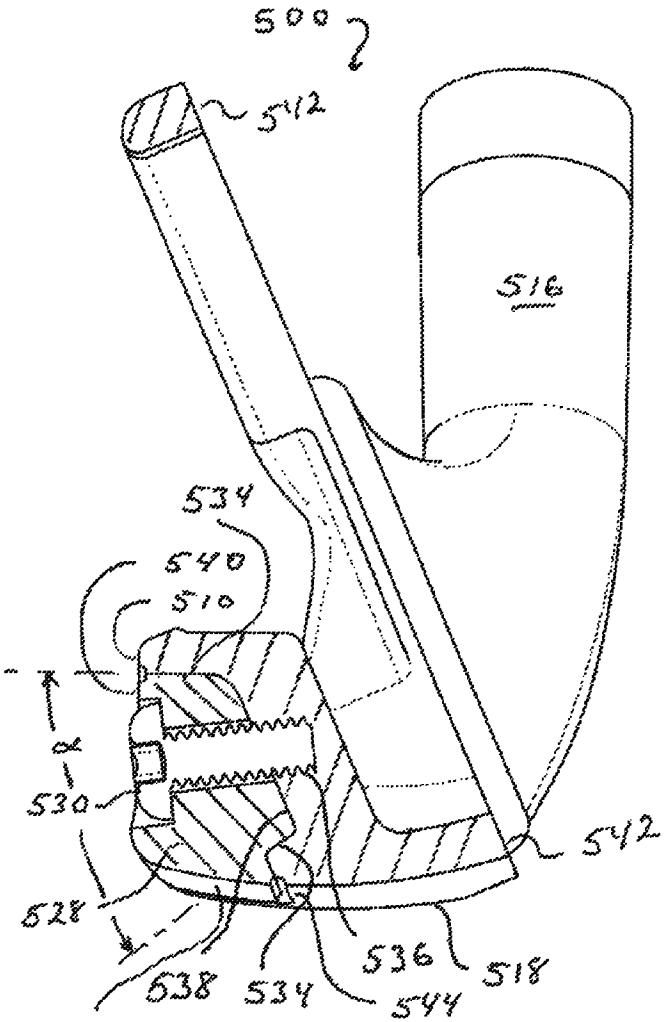
FIG. 9 is a cross-sectional view of the iron in FIG. 8.

As shown in FIG. 10, the iron body 600, includes a heel 612, a toe 614, a hosel 616 and a sole 618 and is preferably formed by forging steel or titanium as discussed above. The club head also includes a toe weight member 628 that is coupled to the body 600 by a mechanical fastener 630. Like the embodiment in FIG. 8, the body 600 includes an indentation 632 on the toe 614 and sole 618 for receiving the weight member 628. The indentation 632 includes an inner wall 634 that surrounds a portion of the weight member 628 and a receptacle 636 for coupling with the mechanical fastener 630. In this embodiment, the indentation 632 further includes a conical collar 637. As shown in the cross-sectional view of FIG. 11, the conical collar 637 is formed at an angle $\beta$ such that the weight member is press fit into the indentation 632 when the mechanical fastener is tightened. Again, the weight member 628 and the indentation 632 form a bottom interface 638 that can include an adhesive tape juxtaposed the interface to further secure the weight member 628 to the body 600. As above, the outer surface of the weight member 628 preferably creates a lower portion of the toe 614, an outer portion of the sole 618 and a portion of the back surface 610 for maximum MOI efficiency. The body 600 also includes a front surface 642 for welding the front face, not shown, to and a paint fill edge 644 can be formed in the weight member 628, the body 600 or both, as shown, to finish the club head and provide a visual separation of the weight member 628.

Even with the additional conical collar 637, the toe weight member 628 preferably has a mass of about 35 to 55 grams and the toe weight member 628 mass increases with each club by about 5 grams per club. Preferably, the tungsten mass of the toe weight member 628 and any heel weight member are at least 25% of the total club head mass and at least 15% of the total club head solid volume.

Figure 12:
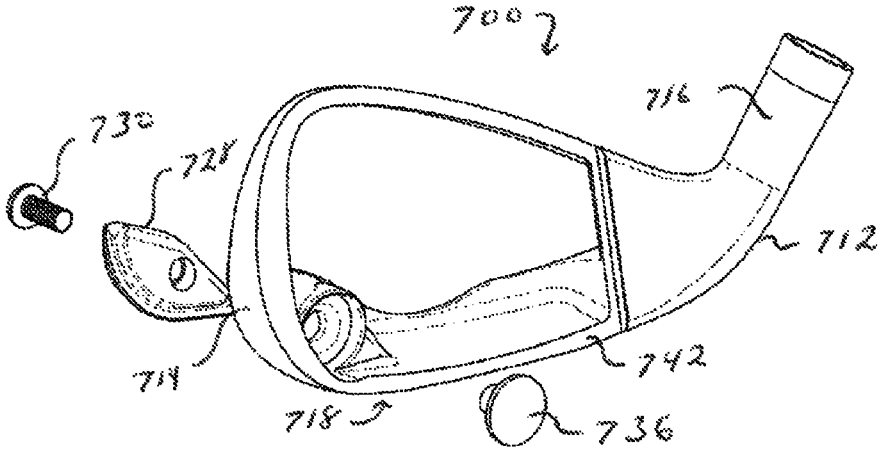
FIG. 12 is an exploded view of an iron according to the present invention.
Figure 13:
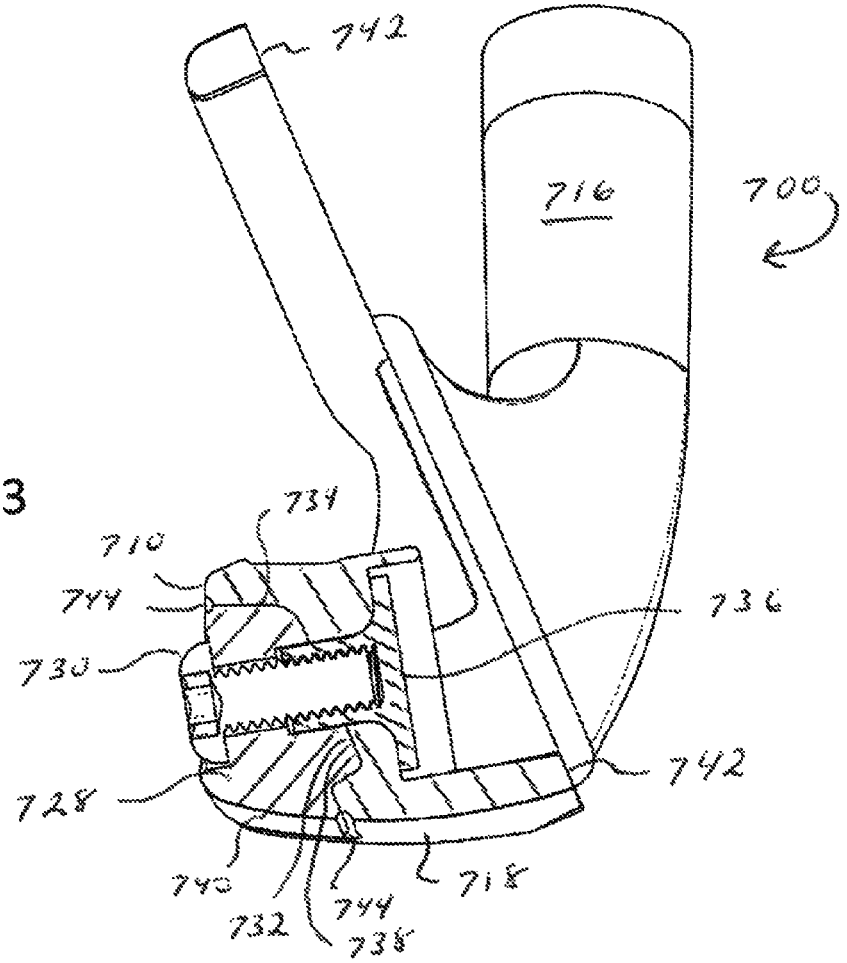
FIG. 13 is a cross-sectional view of the iron in FIG. 12.

FIG. 12 is an exploded view of another embodiment of the present invention. The iron body 700, includes a heel 712, a toe 714, a hosel 716 and a sole 718 and is preferably formed by forging steel or titanium as discussed above. The club head 700 also includes a toe weight member 728 that is coupled to the body 700 by a mechanical fastener 730. Like the embodiment in FIG. 8, the body 700 includes an indentation 732 on the toe 714 and sole 718 for receiving the weight member 728. The indentation 732 includes an inner wall 734 that surrounds a portion of the weight member 728. In this embodiment, as shown in FIG. 13, a threaded receptacle member 736 is inserted into the body 700 through the face side of the body 700 for coupling with the mechanical fastener 730. In this embodiment, the receptacle member 736 is covered from view when the face member, not shown, is welded to the face securing surface 742. As shown in the cross-sectional view of FIG. 13, the fastener 730 and the receptacle member 736 capture the weight member 728 to the body 700. Again, the weight member 728 and the indentation 732 form a bottom interface 738 that can include an adhesive tape juxtaposed the interface to further secure the weight member 728 to the body 700. As above, the outer surface of the weight member 728 preferably creates a lower portion of the toe 714, an outer portion of the sole 718 and a portion of the back surface 710 for maximum MOI efficiency. The body 700 also includes a paint fill edge 744 can be formed in the weight member 728, the body 700 or both, as shown, to finish the club head and provide a visual separation of the weight member 728.

Figure 14:
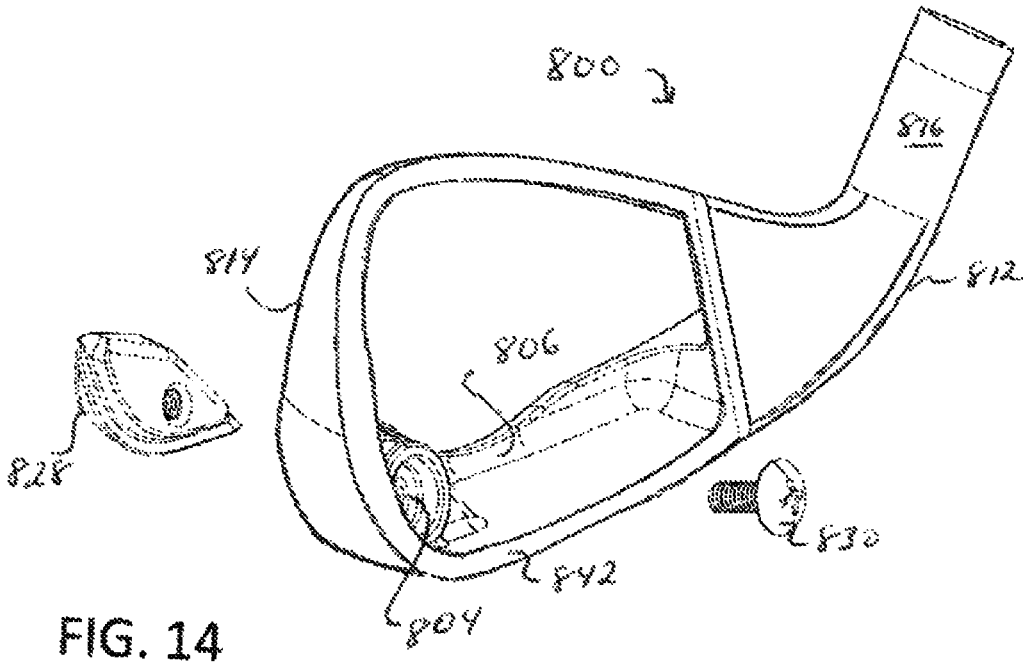
FIG. 14 is an exploded view of an iron according to the present invention.
Figure 15:
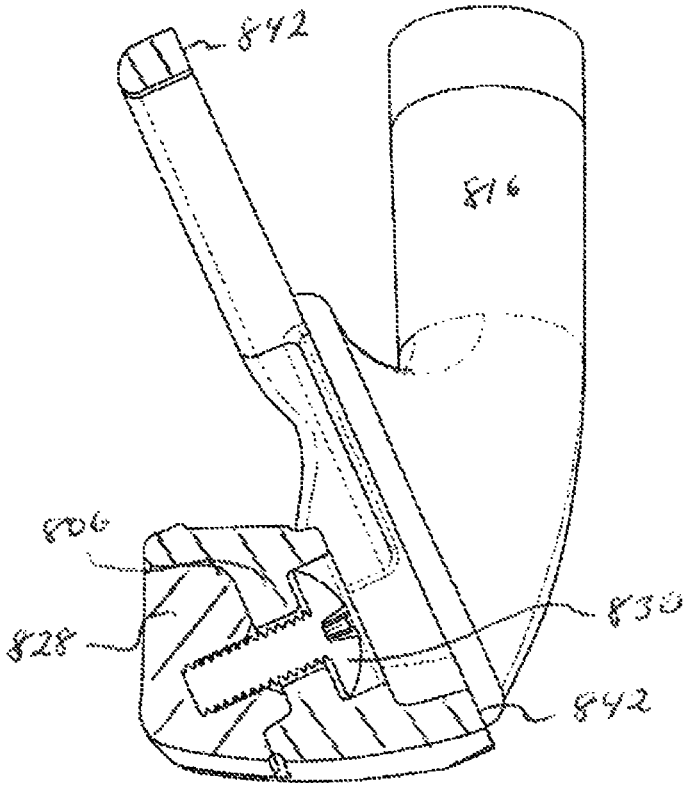
FIG. 15 is a cross-sectional view of the iron in FIG. 14.

Referring to FIGS. 14 and 15, another embodiment of the present invention is an iron body 800 including a heel 812, a toe 814, a hosel 816 and a sole 818. The iron 800 further comprises a toe weight member 828 that is secured to the body 800. In this embodiment, the weight member 828 is secured to the body 800 by a mechanical fastener 830 that is inserted through the face of the iron 800. The iron body 800 can be formed by casting, but is preferably forged. An aperture 804 is formed in the back wall 806 and the weight member 828 is attached to the back wall 806 via the mechanical fastener 830 that is inserted through the face. Then, a face member can be welded to the face retaining surface 842.

As in the other embodiments, the toe weight member 828 preferably has a mass of about 35 to 55 grams. Preferably, the toe weight member 828 mass increases with each club by about 5 grams per club. The club can further include a heel weight member that is not shown that is preferably about 30 grams to 35 grams and preferably decreases by about 1 or 2 grams per club. A heel weight can be attached in the same manner as the toe weight member shown or can be placed behind the face insert as discussed above with respect to FIGS. 4 and 5. Preferably, the tungsten mass of the toe weight member 828 and the heel weight member are at least 25% of the total club head mass and at least 15% of the total club head solid volume. In yet another embodiment, the body 800 can include a hosel weight instead of a heel weight to further increase the MOI about the horizontal axis.

Figure 16:
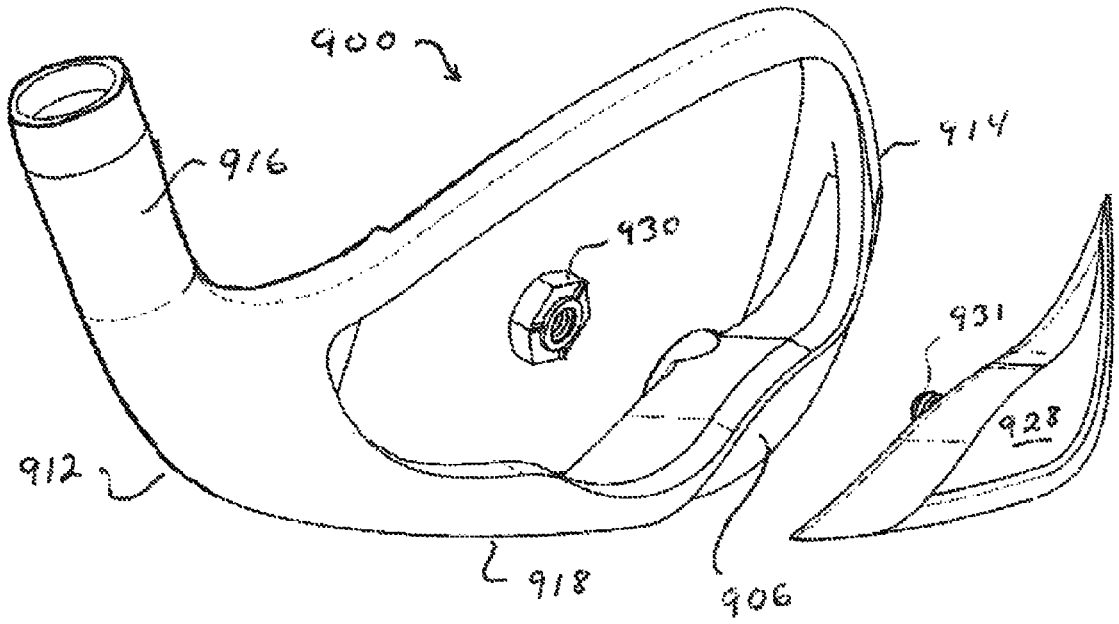
FIG. 16 is an exploded view of an iron according to the present invention.

Referring to FIG. 16, another embodiment of the present invention is an iron body 900 including a heel 912, a toe 914, a hosel 916 and a sole 918. The iron 900 further comprises a toe weight member 928 that is coupled to the body 900. In this embodiment, the weight member 928 is coupled to the body 900 by a mechanical fastener 930 that is nut fastener inserted through the face of the iron 900 that tightens onto a threaded portion 931 of the weight member 928. The iron body 900 can be formed by casting, but is preferably forged. An aperture is formed in the back wall 906 and the weight member 928 is attached to the back wall 906 via the mechanical fastener 930 that is inserted through the face. Then, a face member can be welded to the face retaining surface.

Figure 17:
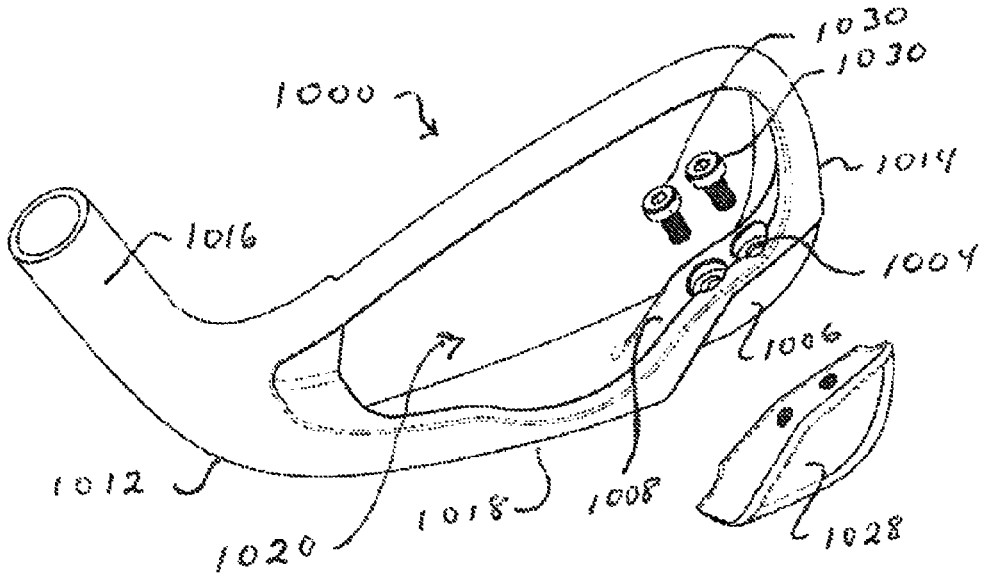
FIG. 17 is an exploded view of an iron according to the present invention.

Referring to FIG. 17, another embodiment of the present invention is an iron body 1000 including a heel 1012, a toe 1014, a hosel 1016 and a sole 1018. The iron 1000 further comprises a toe weight member 1028 that is coupled to the body 1000. In this embodiment, the weight member 1028 is coupled to the back surface 1006 of the body 1000 by a plurality of mechanical fasteners 1030 that are inserted through the back cavity 1020 of the iron 1000. More particularly, a plurality of apertures 1004 can be formed in a bottom surface 1008 of the back cavity 1020 such that the threaded fasteners 1030 can couple to the weight member 1028. The iron body 1000 can be formed by casting, but is preferably forged. As shown, a face member can be welded to the face retaining surface, but this embodiment can also allow for the face to be integrally formed with the body 1000.

Figure 18:
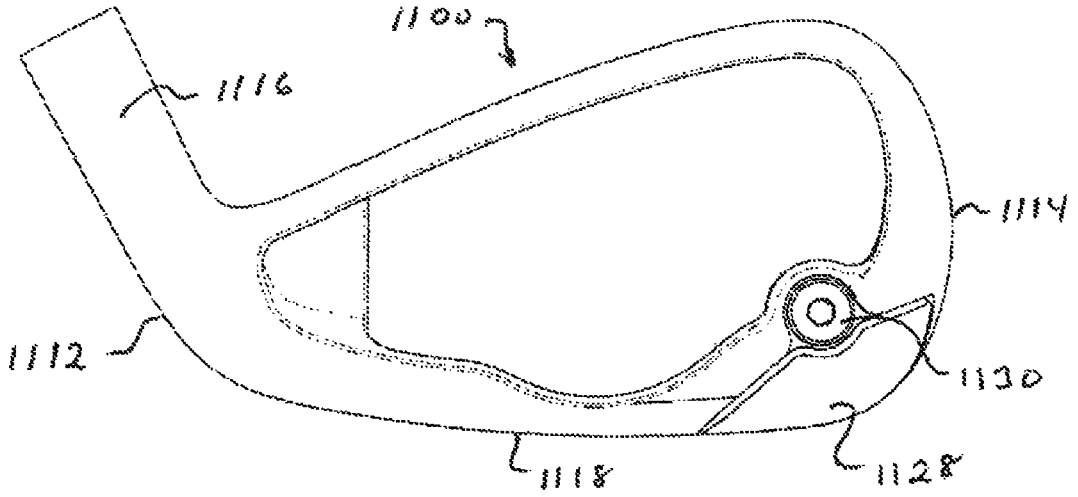
FIG. 18 is a back view of an iron according to the present invention.
Figure 19:
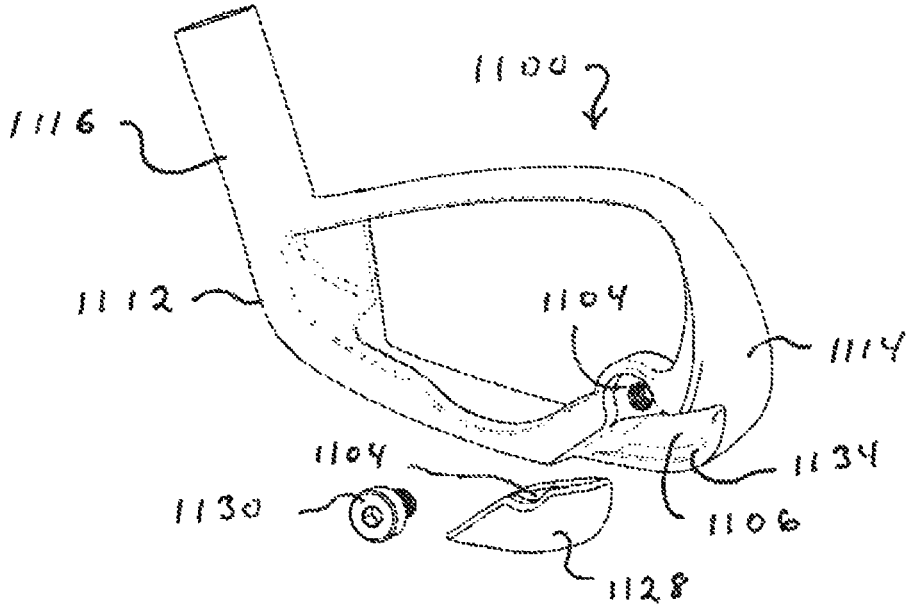
FIG. 19 is an exploded view of the iron in FIG. 18.

Referring to FIGS. 18 and 19, another embodiment of the present invention is an iron body 1100 including a heel 1112, a toe 1114, a hosel 1116 and a sole 1118. The iron 1100 further comprises a toe weight member 1128 that is coupled to the body 1100. In this embodiment, the weight member 1128 is coupled to the body 1100 by a mechanical fastener 1130 that provides an abutting lock. More particularly, a recess 1104 is formed in an outer surface 1108 of the iron body 1100 and the weight member 1128 such that the head of the threaded fastener 1030 can couple the weight member 1128 to the back surface 1106 of the body 1100. A retaining wall 1134 surrounds the weight member 1128 such that the weight member 1128 is press fit when the fastener member 1130 is secured in the recess 1104. The iron body 1100 can be formed by casting, but is preferably forged. As shown, a face member can be welded to the face retaining surface, but this embodiment can also allow for the face to be integrally formed with the body 1100.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all modifications and embodiments which would come within the spirit and scope of the present invention.

What is claimed is:

1. A set of golf clubs comprising at least a first club head having a loft between about 15 and 25 degrees, a second club head having a loft of between about 26 and 35 degrees, and a third club head having a loft of about 36 degrees or greater, wherein:

the first, second and third club heads each comprise a heel, a toe, a topline, a sole, a hosel and a front face having a face center, each club head having a club head mass that is different than the previous club head by at least 5 grams, and wherein at least one of the club heads includes a weight member formed of tungsten and coupled to the toe that comprises 15%-25% of the club head mass;

wherein the weight member is coupled to the golf club via a mechanical fastener to form a portion of a back surface, a toe surface and a sole surface; and wherein the club includes an indentation having a conical collar and a wall having an angle of between about 10 degrees and 60 degrees surrounding a portion of the weight member such that the weight member is press fit into the indentation when the mechanical fastener is tightened.

2. The set of golf clubs of claim 1, wherein the club includes a bottom surface and an adhesive tape is juxtaposed the bottom surface and the weight member.

3. The set of golf clubs of claim 1, wherein the club and the weight member form a paint fill edge that surrounds a weight member perimeter.

4. A set of golf clubs comprising at least a first club head having a loft between about 15 and 25 degrees, a second club head having a loft of between about 26 and 35 degrees, and a third club head having a loft of about 36 degrees or greater, wherein:

the first, second and third club heads each comprise a solid volume, a heel, a toe, a topline, a sole, a hosel and a front face having a face center, wherein at least one of the club heads has an overall club head mass and is comprised of a steel body member and a steel face insert that together comprise less than 75 percent of the overall club head mass and is further comprised of at least a toe weight member formed of tungsten, wherein the weight member comprises between 15% and 25% of the club head mass and is coupled to the body member by a mechanical fastener such that the weight member forms a portion of a sole surface, a toe surface and a back surface; and wherein the club includes an indentation having a conical collar and a wall having an angle of between about 10 degrees and 60 degrees surrounding a portion of the weight member such that the weight member is press fit into the indentation when the mechanical fastener is tightened.

5. A set of golf clubs comprising at least a first golf club, a second golf club, and a third golf club, wherein:

the first, second and third golf clubs are each comprising a heel, a toe, an upper surface, a lower surface, a hosel and a front face having a face center, and the first golf club further comprising a first loft angle ($LA_1$) of between 15 and 25 degrees and a first blade length, a first hosel length and a first scoreline width, and a first tungsten toe weight member, wherein the first tungsten toe weight member is coupled to the golf club via a first mechanical fastener to form a portion of a back surface, a toe surface and a sole surface; and wherein the first club includes a first indentation having a first conical collar and a first wall having an angle of between about 10 degrees and 60 degrees surrounding a portion of the first tungsten toe weight member such that the first tungsten toe weight member is press fit into the first indentation when the first mechanical fastener is tightened;

the second golf club comprising a second loft angle ($LA_2$) of between 26 and 35 degrees and a second blade length, a second hosel length and a second scoreline width, and a second tungsten toe weight member, wherein the second tungsten toe weight member is coupled to the golf club via a second mechanical fastener to form a portion of a back surface, a toe surface and a sole surface; and wherein the second club includes a second indentation having a second conical collar and a second wall having an angle of between about 10 degrees and 60 degrees surrounding a portion of the second tungsten toe weight member such that the second tungsten toe weight member is press fit into the second indentation when the second mechanical fastener is tightened; and the third golf club comprising a third loft angle ($LA_3$) of 36 degrees or greater and a third blade length, a third hosel length and a third scoreline width, and a third tungsten toe weight member, wherein the third tungsten toe weight member is coupled to the third golf club via a third mechanical fastener to form a portion of a back surface, a toe surface and a sole surface; and wherein the third club includes a third indentation having a third conical collar and a third wall having an angle of between about 10 degrees and 60 degrees surrounding a portion of the third tungsten toe weight member such that the third tungsten toe weight member is press fit into the third indentation when the third mechanical fastener is tightened;

wherein the second tungsten toe weight member has greater mass than the first tungsten toe weight member and the third tungsten toe weight member has greater mass than the second tungsten toe weight member.

* * * * *